US008801402B2

(12) United States Patent
Chu et al.

(10) Patent No.: US 8,801,402 B2
(45) Date of Patent: Aug. 12, 2014

(54) AIR COMPRESSION DEVICE

(75) Inventors: Yi-Lin Chu, New Taipei (TW); Yi-Hung Hsu, New Taipei (TW)

(73) Assignee: Cycle Arrow Technology Co. Ltd., New Taipei (TW)

( * ) Notice: Subject to any disclaimer, the term of this patent is extended or adjusted under 35 U.S.C. 154(b) by 438 days.

(21) Appl. No.: 13/089,997

(22) Filed: Apr. 19, 2011

(65) Prior Publication Data

US 2011/0236232 A1 Sep. 29, 2011

(30) Foreign Application Priority Data

Apr. 20, 2010 (TW) ..... 99207202

(51) Int. Cl.
*F04B 17/00* (2006.01)
*F04C 18/12* (2006.01)
*F04C 28/14* (2006.01)

(52) U.S. Cl.
CPC ..... *F04C 18/123* (2013.01); *F04C 28/14* (2013.01)
USPC ..... 417/410.4; 418/205; 418/206.1

(58) Field of Classification Search
CPC ..... F04C 18/123; F04C 28/14; F04C 2240/81
USPC ..... 417/410.4; 418/205, 206.1, 206.2, 418/206.5
See application file for complete search history.

(56) References Cited

U.S. PATENT DOCUMENTS

| | | | | |
|---|---|---|---|---|
| 3,954,047 | A * | 5/1976 | Miniere | 91/467 |
| 4,645,439 | A * | 2/1987 | Way | 418/104 |
| 6,508,639 | B2 * | 1/2003 | Chen et al. | 418/9 |
| 6,776,594 | B1 * | 8/2004 | Heng-I et al. | 418/206.5 |
| 2003/0192503 | A1 * | 10/2003 | James | 123/249 |
| 2005/0112014 | A1 * | 5/2005 | Shiromaru et al. | 418/206.1 |
| 2009/0000680 | A1 * | 1/2009 | Friedman | 137/896 |

* cited by examiner

*Primary Examiner* — Peter J Bertheaud
*Assistant Examiner* — Dominick L Plakkoottam
(74) *Attorney, Agent, or Firm* — Muncy, Geissler, Olds & Lowe, P.C.

(57) ABSTRACT

An air compression device is applied in an air compressor. A rotatable pressure regulating disk and a valve are disposed in a rotor set. When external air enters an air chamber in the rotor set, the air is exhausted after being compressed through rotation of a first rotor and a second rotor. When the two rotors compress the air, a user may control the pressure regulating disk to rotate to advance or postpone exhaust of the air from the valve, so as to change an exhaust pressure in the air chamber to adjust an exhaust volume output by the rotor set. An adjustable air intake disk may further be added, so that timing adjustment can be performed during both air intake and exhaust.

7 Claims, 10 Drawing Sheets

AIR COMPRESSION DEVICE

BACKGROUND OF THE INVENTION

1. Field of the Invention

The present invention relates to an air compression device mounted in an air compressor, and more particularly to an air compression device capable of adjusting exhaust timing of a valve so as to change an exhaust pressure.

2. Related Art

In a common air compressor, a set of air compression device is assembled to compress a gas drawn by the air compressor before the gas is exhausted. FIG. 1 is a schematic sectional view of a conventional air compression device. Referring to FIG. 1, an air chamber 101 is formed in an air compression device 10. A valve 102 is formed in the air chamber 101. The valve 102 is fixed, and is formed across an inner wall of the air chamber 101. A first rotor 1011 and a second rotor 1012 are assembled in the air chamber 101 respectively. When external air enters (as indicated by an arrow A in the figure), the first rotor 1011 and the second rotor 1012 are driven by an electric current to rotate synchronously. According to the figure, when the air just enters the air chamber 101, the first rotor 1011 is at the beginning of a stroke, and at this moment, the first rotor 1011 completely covers the valve 102. FIG. 2 is a schematic view of action of the conventional air compression device. Referring to FIG. 2, when the first rotor and the second rotor (1011, 1012) rotate, the air is gradually compressed to form compressed air A1, and after the first rotor 1011 rotates, the valve 102 covered by the first rotor 1011 is gradually exposed to be in an opened state to exhaust the compressed air A1 from the valve 102, so that through the action, air intake, compression, and exhaust strokes are completed continuously. Accordingly, after entering the air chamber 101, the external air is compressed by the two rotors (1011, 1012), so that before the air is exhausted, an exhaust pressure in the air chamber 101 increases gradually, an exhaust time point determines the exhaust pressure, and a motor power consumed by the two rotors increases as the exhaust pressure rises. However, the exhaust pressure, output power, and exhaust volume of a common rotor set are fixed. When a user needs a smaller exhaust volume, if the output motor power is high, energy is wasted; on the contrary, the exhaust may not be sufficient, which affects the efficiency of action of a connected mechanism. For example, when the air compression device is applied in an air intake system of a vehicle engine, since the difference between an exhaust volume required by a motorcar and an exhaust volume required by a locomotive is obviously large, in order to meet the demands of providing various exhaust volumes, multiple sets of the air compression devices are required, which greatly limits the application of the compressed air, and also leads to a high manufacturing cost.

SUMMARY OF THE INVENTION

Accordingly, the present invention is directed to an air compression device, which can adjust an exhaust pressure according to demands, so as to change a motor power and an exhaust volume.

In order to achieve the above objective, in the air compression device of the present invention, a pressure regulating disk is assembled. When external air enters an air chamber, the pressure regulating disk is rotated to change a position of a valve during a compression stroke of a first rotor and a second rotor, to advance or postpone exhaust of the compressed external air, so as to change an exhaust pressure in the air chamber, thus relatively adjusting a motor power and an exhaust volume.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
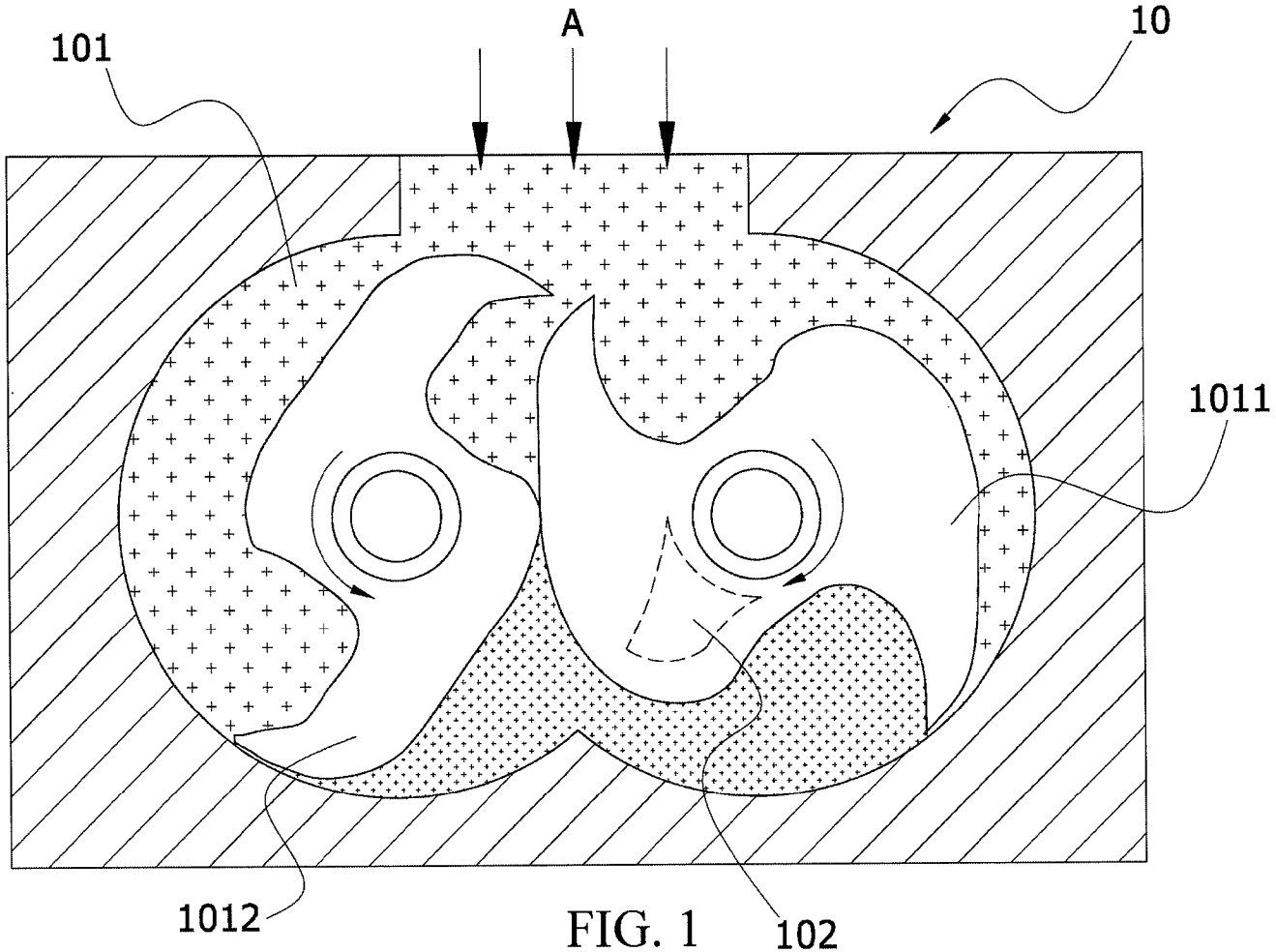
FIG. 1 Prior Art
FIG. 1 is a schematic sectional view of a conventional air compression device.
Figure 2:
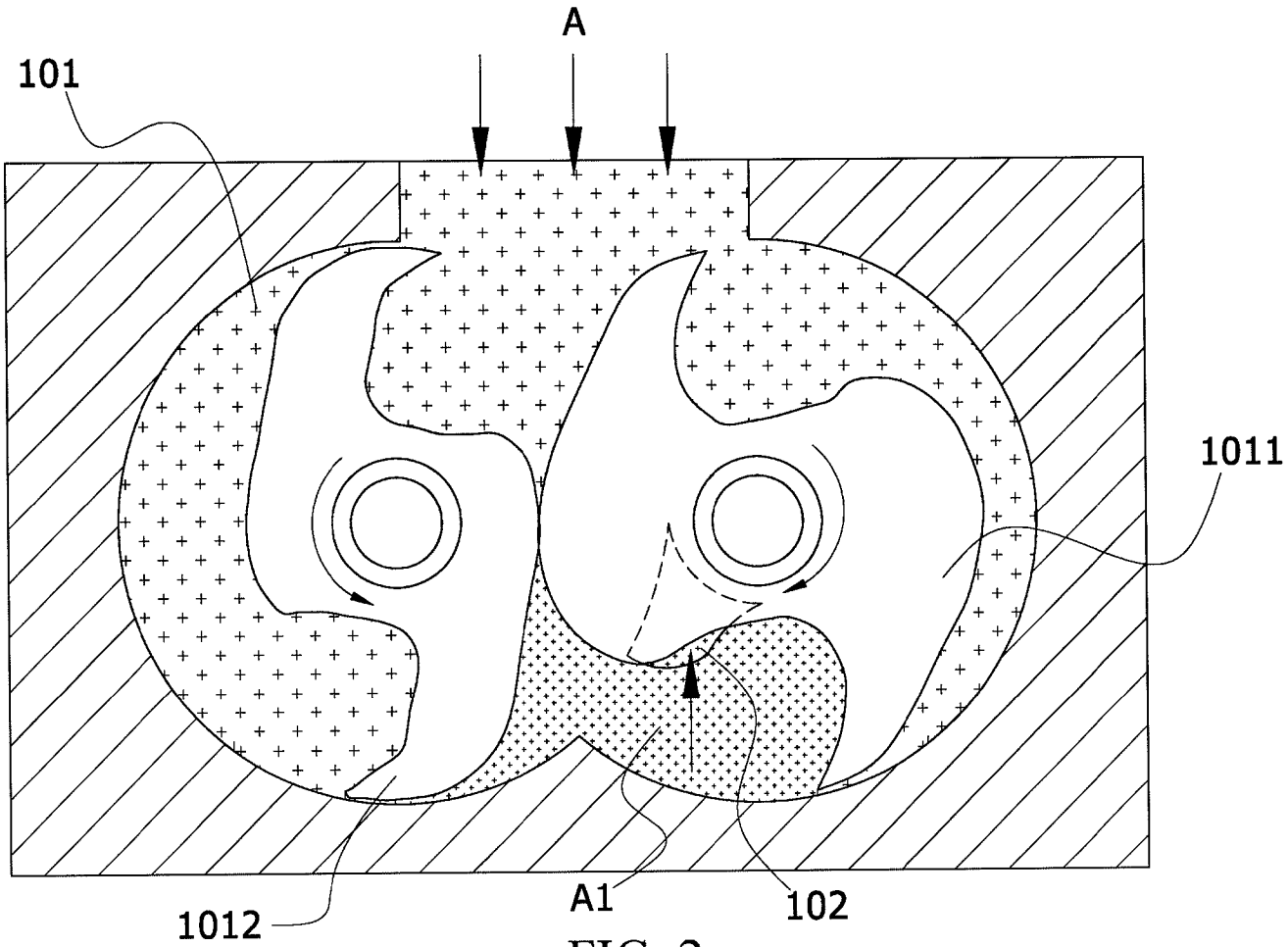
FIG. 2 Prior Art
FIG. 2 is a schematic view of action of a conventional air compression device.
Figure 3:
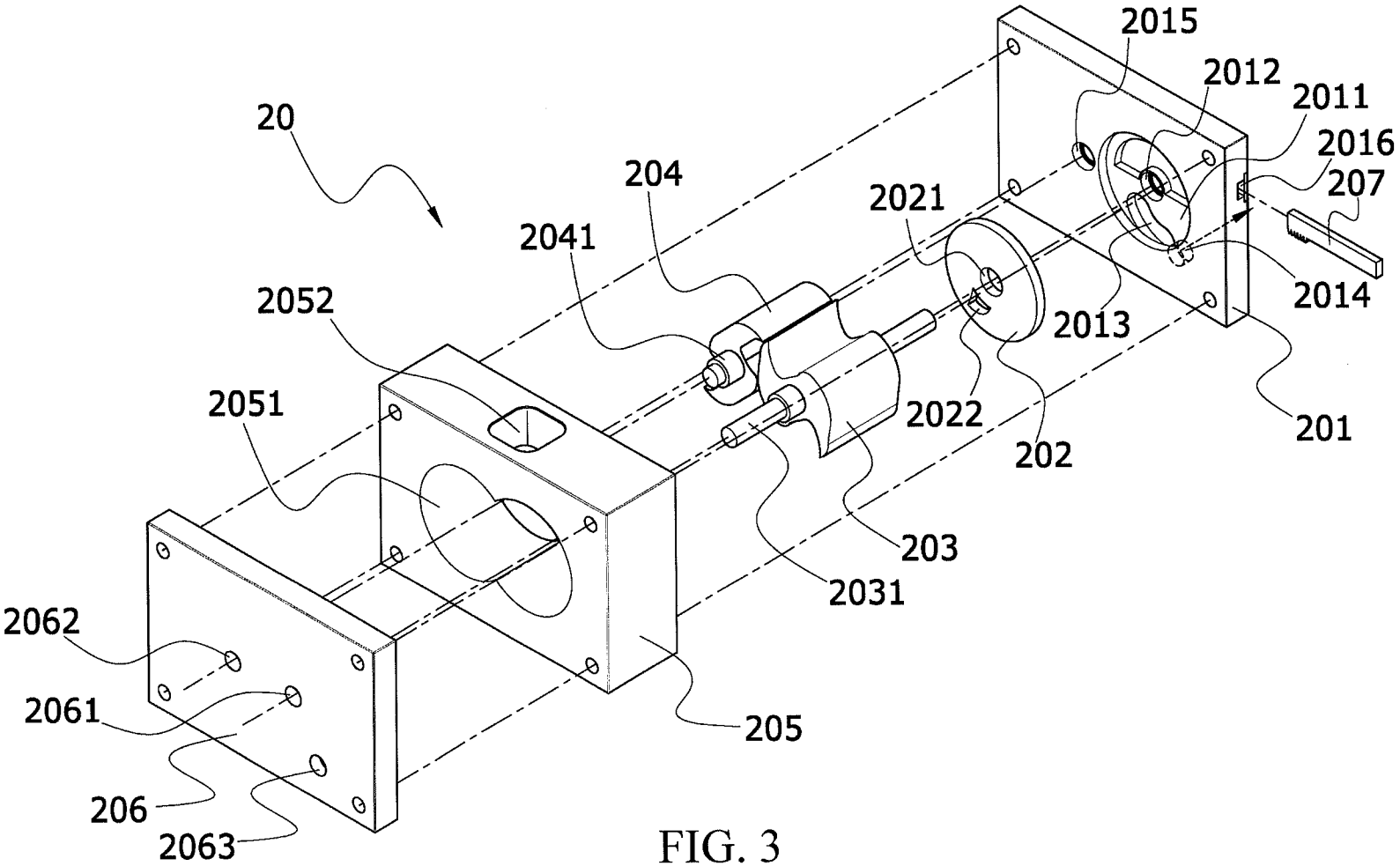
FIG. 3 is a schematic view of components according to the present invention.
Figure 4:
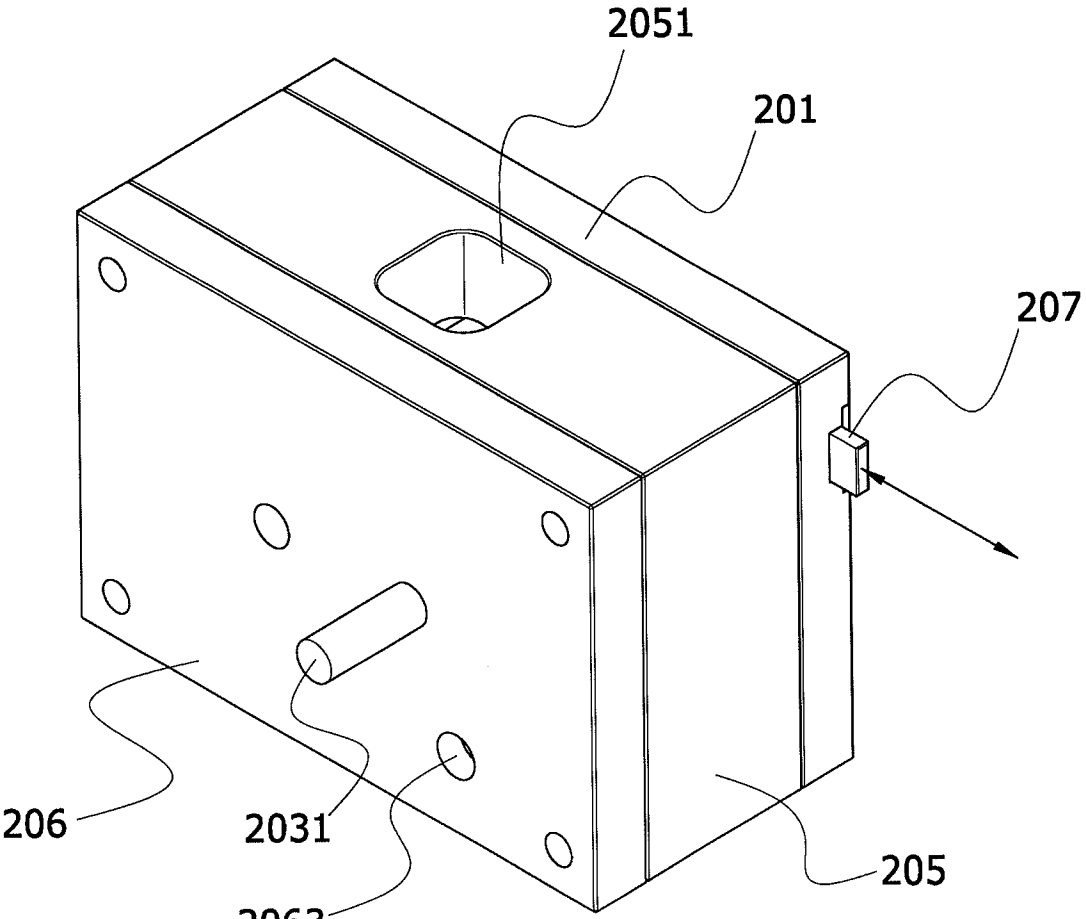
FIG. 4 is a three-dimensional outside view of the present invention.

FIG. 3 is a schematic view of components according to the present invention. Referring to FIG. 3, an air compression device 20 mainly includes a first cover body 201, a pressure regulating disk 202, a first rotor 203, a second rotor 204, a main seat body 205, a second cover body 206, and an actuating portion 207. An accommodation slot 2011 is formed on a side surface of the first cover body 201, a first shaft hole 2012 is formed in the middle of the accommodation slot 2011, and an exhaust passage 2013 is formed at a bottom of the accommodation slot 2011. The exhaust passage 2013 is in communication with an exhaust hole 2014 formed on another side surface of the first cover body 201. In addition, a second shaft hole 2015 is formed at a position near the first shaft hole 2012, and a passage 2016 in communication with the accommodation slot 2011 is formed on a side edge of the first cover body 201, through which the actuating portion 207 (for example, a transverse lever) passes. A shaft hole 2021 is formed in the pressure regulating disk 202. A valve 2022 running through a disk body is formed on a surface of the disk body. A gear disk 2023 (not shown) is fixedly disposed at the back of the pressure regulating disk 202. A rotor shaft 2031 is assembled at the first rotor 203, and a rotor shaft 2041 is assembled at the second rotor 204. One end of the rotor shaft 2031 runs through the shaft hole 2021 of the pressure regulating disk 202, and is pivoted in the first shaft hole 2012 of the first cover body 201. One end of the rotor shaft 2041 is pivoted in the second shaft hole 2015 of the first cover body 201. Therefore, after being pivoted, the two rotors (203, 204) can rotate synchronously relative to the first cover body 201. The main seat body 205 may be assembled on an opposite surface of the first cover body 201, and an air chamber 2051 is formed in the main seat body 205. The two rotors (203, 204) are movably assembled in the air chamber 2051 respectively. In addition, an air inlet 2052 is formed at the top of the main seat body 205, and is in communication with the air chamber 2051, so as to enable external air to enter the air chamber 2051. After the components are assembled, the second cover body 206 is further assembled on one side of the main seat body 205. Two shaft holes (2061, 2062) formed in the second cover body 206 are penetrated by the other ends of the rotor shafts (2031, 2041), so that both of the two ends of the rotors (203, 204) are pivoted, thus enabling the two rotors (203, 204) to rotate in the air chamber 2051. After the assembly, a closed state is formed in the air chamber 2051. In addition, an exhaust hole 2063 may also be formed in the second cover body 206, and is in communication with the air chamber 2051, so that release of an exhaust pressure is more balanced. That is, exhaust can be performed on two sides of the air chamber 2051 at the same time. Accordingly, FIG. 4 is a three-dimensional outside view according to the present invention after the components are assembled. In addition, the second cover body 206 and the main seat body 205 may also be integrally formed.

Figure 5:
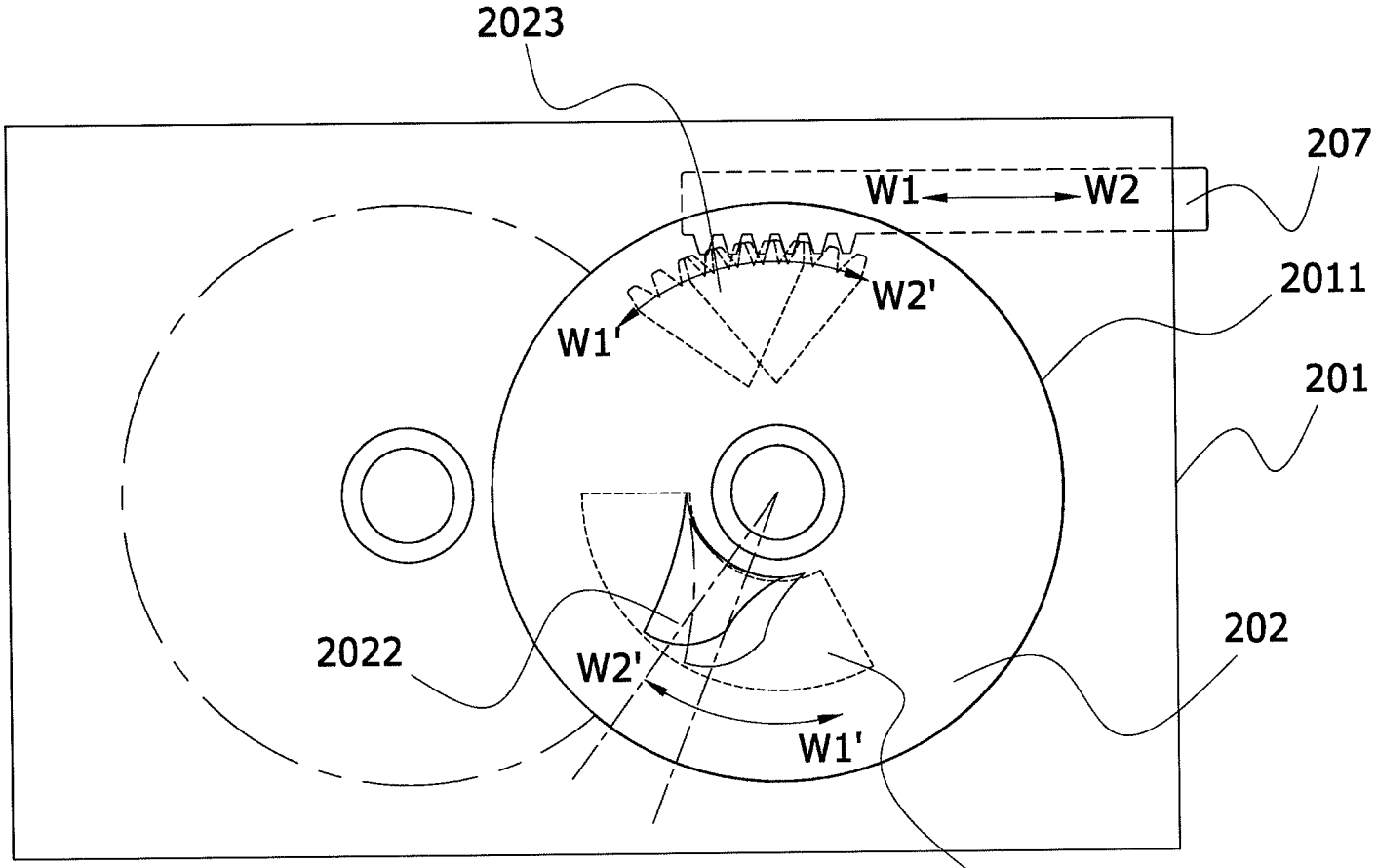
FIG. 5 is a schematic implementation view (1) of the present invention.

FIG. 5 is a schematic implementation view (1) of the present invention. Referring to FIG. 5 and FIG. 3, the accommodation slot 2011 of the first cover body 201 is assembled with the pressure regulating disk 202, the gear disk 2023 at the back of the pressure regulating disk 202 is in a linkage state with the actuating portion 207, and in the linkage state, a linked motion is achieved through engagement of gears. Referring to FIG. 5, the valve 2022 of the pressure regulating disk 202 in a normal state is in communication with the exhaust passage 2013 in the accommodation slot 2011. After a transverse displacement, the actuating portion 207 in the present invention may enable the pressure regulating disk 202 to deflect through linkage by using a transmission function of the gear disk 2023. Referring to the figure, for example, when the actuating portion 207 moves towards the passage 2016 (in an arrow direction W1), the gear disk 2023 enables the pressure regulating disk 202 to deflect (for example, in an arrow direction W1') through linkage, and meanwhile enables the valve 2022 to deflect towards a position of the arrow direction W1'. On the contrary, if the actuating portion 207 moves outwards (for example, in an arrow direction W2) through the passage 2016, the valve 2022 deflects in an arrow direction W2'. Therefore, through a relative displacement of the actuating portion 207, a position of the valve 2022 on the pressure regulating disk 202 is changed, and the valve 2022 moves relative to the exhaust passage 2013.

Figure 6:
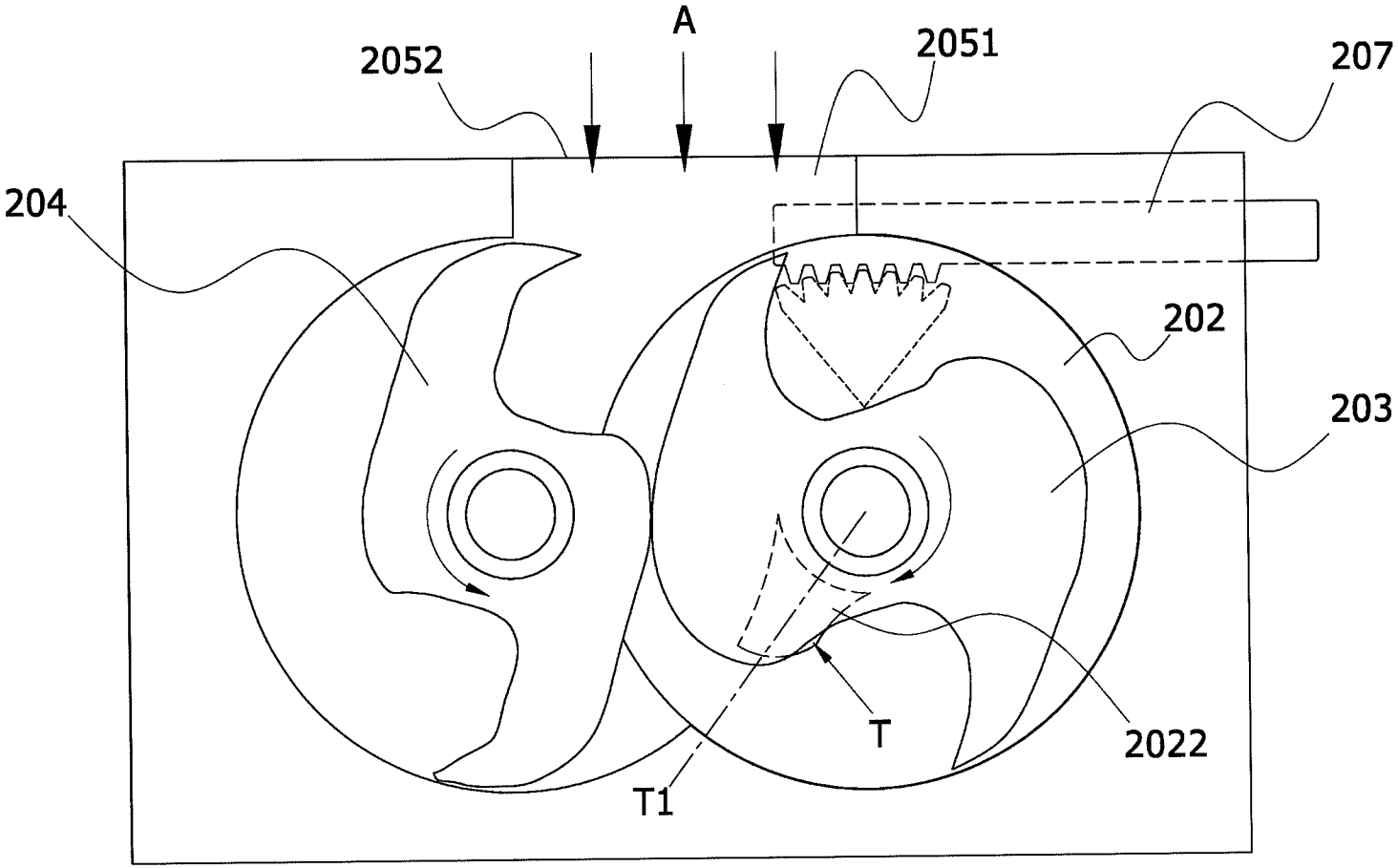
FIG. 6 is a schematic implementation view (2) of the present invention.
Figure 7:
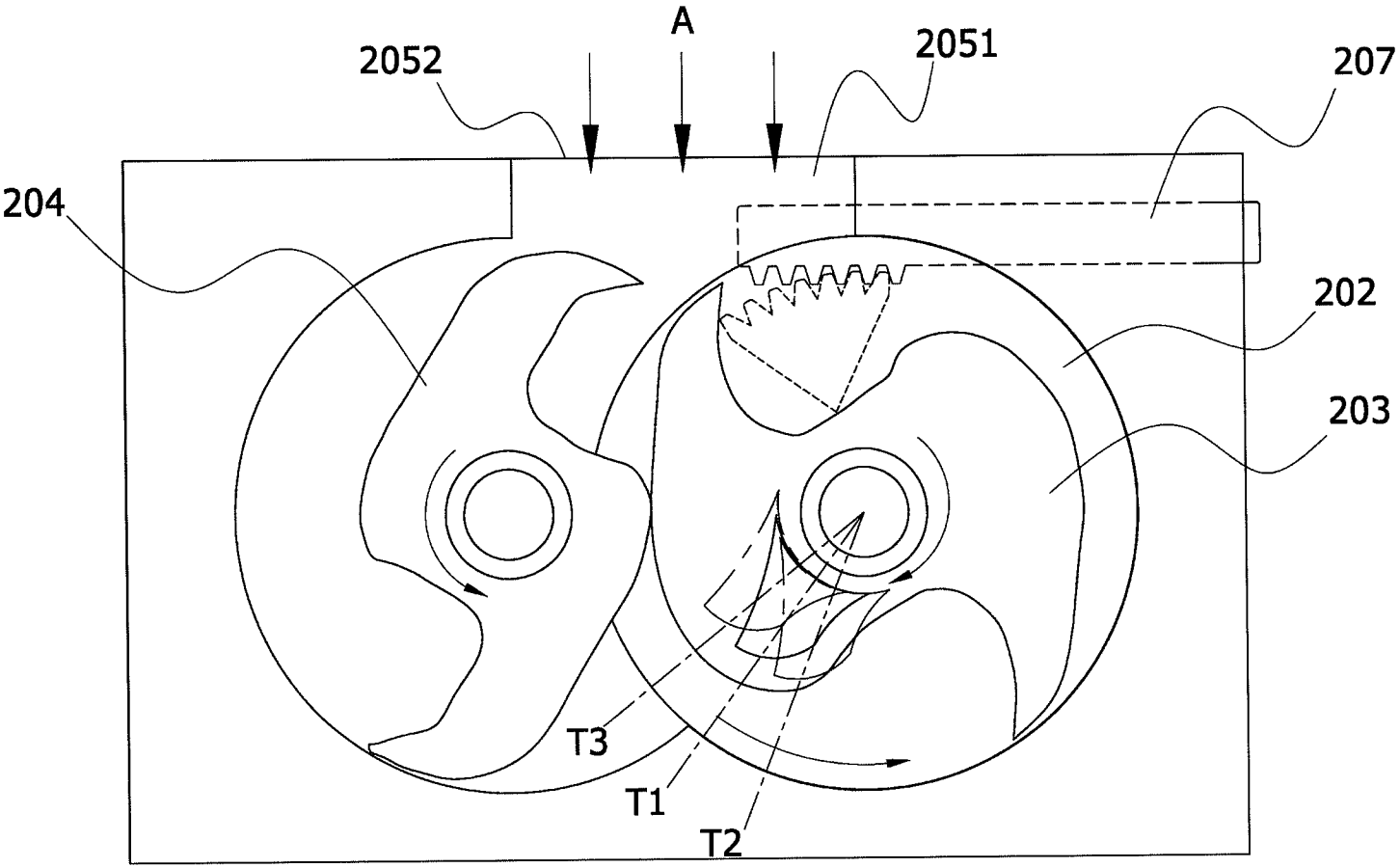
FIG. 7 is a schematic implementation view (3) of the present invention.

FIG. 6 is a schematic implementation view (2) of the present invention. Referring to FIG. 6, after the external air enters the air chamber 2051 through the air inlet 2052, the air is compressed by the two rotors (203, 204), and an exhaust pressure in the air chamber 2051 is determined by an exhaust volume and a consumed motor power. Therefore, if a compressing time is longer (that is, the exhaust of the compressed air is postponed), the pressure becomes greater; and on the contrary, the pressure becomes smaller. Referring to FIG. 6, in normal action, a timing point T of the valve 2022 of the pressure regulating disk 202 is at an original position T1, which is an initial state set according to an original air pressure. That is, when no special demand of the air pressure is put forward, the exhaust time is the time when the two rotors (203, 204) rotate to the original position T1 and the valve 2022 gradually enters an opened state, and at this moment, the compressed air starts to be exhausted. FIG. 7 is a schematic implementation view (3) of the present invention. Referring to FIG. 7, assuming that a special demand is put forward to require the compressed air to be output in advance, in this case, the pressure regulating disk 202 deflects after being driven by the actuating portion 207, and meanwhile the original position of the valve 2022 of the pressure regulating disk 202 is rotated from T1 to the position T2. Therefore, in terms of the compression stroke of the two rotors (203, 204), the timing point T of the valve 2022 is shifted forwards (that is, as show in the figure, from the original position T1 to the position T2), and in this case, when the compression stroke of the two rotors (203, 204) reaches the position T2, air exhaust is already started. Therefore, if the exhaust of the compressed air is required to be postponed according to an actual demand, it can be achieved by using the actuating portion 207 to drive the pressure regulating disk 202 to deflect, so that the timing point T of the valve 2022 is rotated from the position T1 to the position T3. In view of the above, in the present invention, the time to compress and exhaust the air is adjusted by rotating the pressure regulating disk 202 to change the exhaust pressure in the air chamber 2051, so that a user can adjust the motor power to be consumed by the rotor set and the exhaust volume freely.

Figure 8:
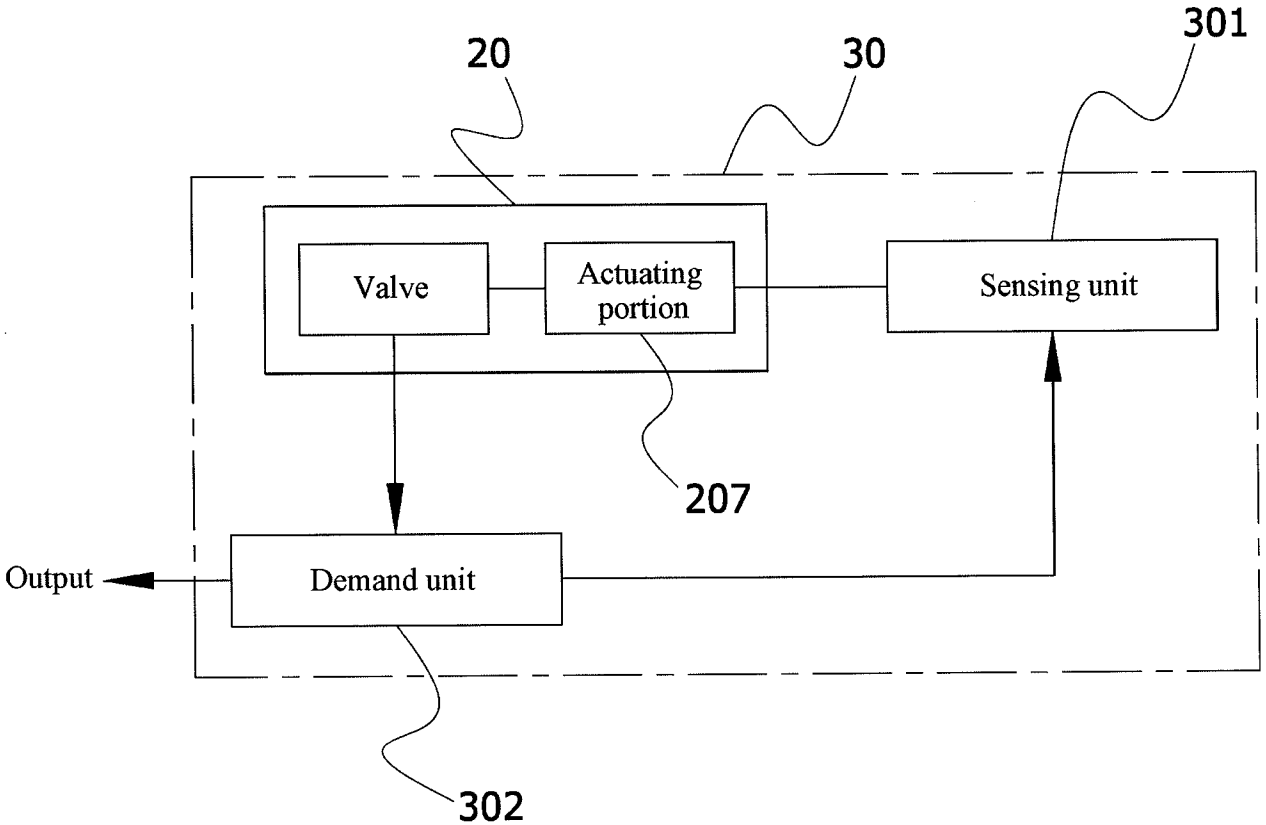
FIG. 8 is a schematic view of a preferred embodiment (1) of the present invention.

FIG. 8 is a schematic view of a preferred embodiment (1) of the present invention. Referring to FIG. 8, the present invention may further be applied to an engine system 30, and a sensing unit 301 (for example, a sensing chip) is used, so that an exhaust volume of the air compression device 20 can be adjusted automatically, thus meeting an actual power output demand. Referring to FIG. 8, the actuating portion 207 of the air compression device 20 assembled in the engine system 30 (for example, an engine system of a locomotive) is electrically connected to the sensing unit 301. The sensing unit 301 can sense and detect a situation in the engine system (that is, a demand unit 302 shown in the figure, such as a carburetor system), so as to drive the actuating portion 207 to act to change a timing position of the valve 2022, thereby adjusting an exhaust pressure in the air compression device 20. For example, when the power of a locomotive increases, the rotation speed of the engine rises correspondingly, and the exhaust volume of the engine also increases. In this case, the sensing unit 301 detects the situation of the demand unit 302, and drives the actuating portion 207 to act correspondingly, so as to make the exhaust pressure generated by the air compression device 20 meet a current power output demand of the engine. One or more linkage mechanisms may exist between the sensing unit 301 and the actuating portion 207, such as a gear-type actuator, an airbag-type actuator, a handspike or a lever, a spring, and an oil hydraulic mechanism.

Figure 9:
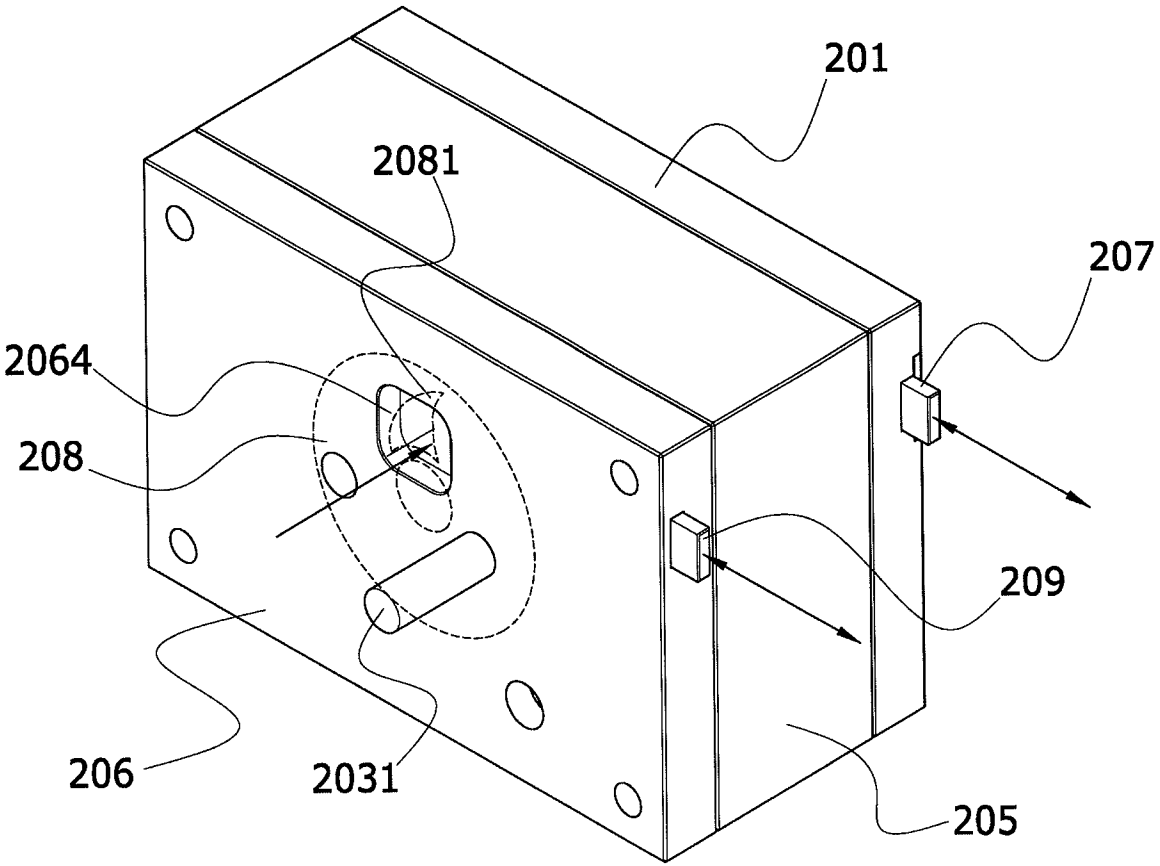
FIG. 9 shows a preferred embodiment (2) of the present invention.

FIG. 9 shows a preferred embodiment (2) of the present invention. Referring to FIG. 9, in order to make the air compression device of the present invention better meet the actual application demands, in the present invention, an air inlet is formed at a side portion of the air chamber 2051 of the air compression device (referring to FIG. 3), and the air inlet is designed to be adjustable to change the timing of the valve during air intake. Referring to FIG. 9, an air inlet 2064 is formed in one of the first cover body 201 and the second cover body 206 (for the convenience of description, in this embodiment, the air inlet 2064 is formed in the second cover body 206). In addition, an air intake adjustment disk 208 is assembled on a surface of the second cover body 206 facing the main seat body 205, and a structure of the air intake adjustment disk 208 is the same as that of the pressure regulating disk 202 for air exhaust (referring to FIG. 3). A valve 2081 is formed at the air intake adjustment disk 208, and in a normal state, a position of the valve 2081 corresponds to the air inlet 2064. Referring to the figure, another actuating portion 209 is assembled on a side surface of the second cover body 206, and one end of the actuating portion 209 is linked to the air intake adjustment disk 208. When the actuating portion 209 moves, the air intake adjustment disk 208 is moved synchronously through linkage to make the valve 2081 deflect to meet a demand of adjusting air intake timing.

Figure 10:
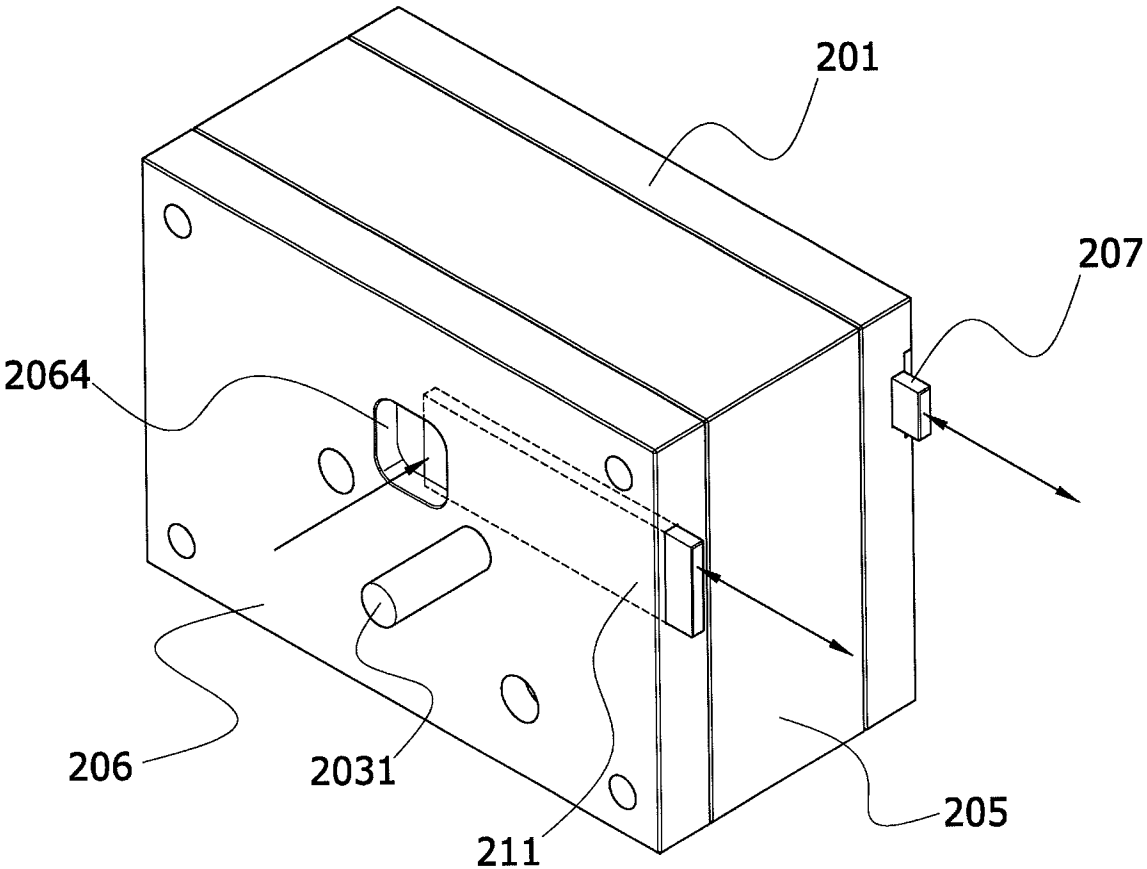
FIG. 10 shows a preferred embodiment (3) of the present invention.

FIG. 10 shows a preferred embodiment (3) of the present invention. Referring to FIG. 10, an air intake adjustment lever 211 capable of blocking air intake is assembled at one of the first cover body 201 and the second cover body 206 (for the convenience of description, in this embodiment, the air intake adjustment lever 211 is formed at the second cover body 206), and one end of the air intake adjustment lever 211 is near the air inlet 2064 and in a normal state, does not interfere with an air intake process of the air inlet 2064. In addition, the air intake adjustment lever 211 can perform linear movement action. When an air intake volume is require to be adjusted, the air intake adjustment lever 211 takes action to make an end thereof overlap (interfere with) the air inlet 2064, so as to adjust the air intake volume.

Accordingly, in the structures of the present invention, the valve timing adjustable during exhaust plays the main role, and if a combination of multiple air intake and exhaust requirements is required according to actual demands, the aforementioned structure may further be introduced, so as to adjust both the valve timing during the air intake and exhaust and the air intake volume.

In view of the above, in the present invention, the pressure regulating disk is assembled in the air compression device, and the actuating portion enables the pressure regulating disk to deflect and move through linkage, so that the valve timing point may be changed according to demands, thus changing the exhaust pressure in the air compression device. In addition, the air intake adjustment disk or the air intake adjustment lever may further be added according to demands, so as to adjust the valve timing of the air intake and exhaust according to the demands. Therefore, when applied accordingly, the present invention can provide an air compression device capable of changing a motor power and an exhaust volume of an air compressor.

The above description is merely preferred embodiments of the present invention, but is not intended to limit the scope of the present invention. All the equivalent variations and modifications made by persons skilled in the art without departing from the spirit and scope of the present invention shall fall within the appended claims of the present invention.

What is claimed is:

1. An air compression device, comprising:

a main seat body, having an air inlet, wherein an air chamber is formed in the main seat body, the air inlet is in communication with the air chamber, a first rotor and a second rotor are assembled in the air chamber, and the two rotors rotate relatively to compress air entering the air chamber;

a first cover body, assembled on one side of the main seat body, wherein after the assembly, one end of the first rotor and one end of the second rotor are respectively pivoted in corresponding shaft holes formed in the first cover body, an accommodation slot is formed on a plane of the first cover body, an exhaust passage is formed by inner edges of the accommodation slot, and an exhaust hole is formed at one end of the exhaust passage;

a pressure regulating disk, pivoted in the accommodation slot of the first cover body, and capable of deflecting in the accommodation slot, wherein a valve is formed on a surface of the pressure regulating disk, and after the pressure regulating disk is pivoted at the first cover body, the valve is in communication with the exhaust passage of the first cover body;

an actuating portion, assembled in linkage with the pressure regulating disk, wherein when the actuating portion acts, the pressure regulating disk is made to deflect through linkage; and a second cover body, assembled on another side of the main seat body, so that the other end of the first rotor and the other end of the second rotor are respectively pivoted in corresponding shaft holes formed in the second cover body, wherein a gear disk is formed on a side plane of the pressure regulating disk, so that one end of the actuating portion is engaged with the gear disk to achieve linkage.

2. The air compression device according to claim 1, wherein the second cover body and the main seat body are integrally formed.

3. The air compression device according to claim 1, wherein the actuating portion is connected to a sensing unit, the sensing unit is electrically connected to a demand unit, and the sensing unit detects a power output situation of the demand unit to actuate the actuating portion to act, so as to make the pressure regulating disk deflect through linkage.

4. The air compression device according to claim 3, wherein the sensing unit actuates the actuating portion through a gear-type mechanism.

5. The air compression device according to claim 3, wherein the sensing unit actuates the actuating portion through an airbag-type mechanism.

6. The air compression device according to claim 3, wherein the sensing unit actuates the actuating portion through a handspike-type mechanism.

7. The air compression device according to claim 1, wherein another exhaust hole is formed in the second cover body, and is in communication with the air chamber.

* * * * *